United States Patent [19]

Munson

[11] 4,055,304

[45] Oct. 25, 1977

[54] AUXILIARY BRAKING MEANS FOR IMPACT ARM SPRINKLERS

[75] Inventor: Robert L. Munson, San Dimas, Calif.

[73] Assignee: Rain Bird Sprinkler Mfg. Corporation, Glendora, Calif.

[21] Appl. No.: 699,354

[22] Filed: June 24, 1976

[51] Int. Cl.[2] ..... B05B 3/00

[52] U.S. Cl. ..... 239/230

[58] Field of Search ..... 239/230, 231, 232, 233, 239/252

[56] References Cited

U.S. PATENT DOCUMENTS

| | | | |
|---|---|---|---|
| 2,254,270 | 9/1941 | Coles et al. | 239/252 X |
| 3,765,608 | 10/1973 | Lockwood | 239/230 |
| 3,837,576 | 9/1974 | Rosenkranz | 239/230 |

*Primary Examiner*—John J. Love

*Attorney, Agent, or Firm*—Fulwider, Patton, Rieber, Lee & Utecht

[57] ABSTRACT

An impact type rotary sprinkler is disclosed including a rotatable body and nozzle, an impact arm which oscillates responsive to the kinetic energy of the fluid discharge stream and a primary spring which stores the rotational energy of the oscillating arm rotating to impact against the housing and impart an increment of rotation thereto. The sprinkler is adapted for uniform water distribution over a range of discharge stream kinetic energies in excess of design limits by the provision of a secondary spring which is operable when the impact arm rotates in excess of a predetermined arc due to excessive rotational force being applied to the impact arm. The secondary spring assists the primary spring in urging the impact arm in the opposite direction.

13 Claims, 6 Drawing Figures

AUXILIARY BRAKING MEANS FOR IMPACT ARM SPRINKLERS

BACKGROUND OF THE INVENTION

The present invention relates to rotary sprinklers and more particularly to a new and improved impact type sprinkler.

Impact type fluid sprinklers of the general type to which the present invention relates are known in the art and generally include a rotatable housing having a nozzle and a spring-loaded oscillating impact arm for intermittent impact with the body to impart an increment of rotation thereto. The impact arm is adapted for impingement by the discharge stream against an end portion thereof to rotate the arm away from the discharge stream while the spring acts to reverse the direction of rotation of the arm and causes it to impact against the body. The cycle is repeated to produce a forward drive of the sprinkler by discrete increments.

Correct operation of the sprinkler is dependent on the relationship between the force of the discharge stream on the arm, as primarily determined by water pressure or nozzle size, and the force of the spring which resists the rotational movement of the arm and urges it in a reverse direction. The spring is selected to limit arm rotation to a desired maximum deflection within a range designed for selected water pressures and nozzle sizes. If the force applied to the impact arm by the discharge stream exceeds the design capacity of the spring, over deflection of the arm will occur and cause erratic sprinkler rotation. In extreme situations, the rotational movement of the impact arm may become sufficiently large to completely override the spring, permitting the arm to impact against the back of the body, thereby actually causing reverse rotation of the sprinkler. Further, operation of the sprinkler outside of the range of water pressures and nozzle sizes for which the sprinkler was designed can result in an undesirable water distribution pattern over the area to be irrigated.

The present invention overcomes the foregoing deficiencies of conventional impulse type sprinklers and provides an impact type sprinkler which gives uniform water distribution through a wide range of water pressures and nozzle sizes.

SUMMARY OF THE INVENTION

In accordance with the invention, the sprinkler includes means to compensate for surges or increases in water pressure above the intended operating pressures so that arm travel and arm strokes per minute are maintained substantially within design limitations, and sprinkler rotation remains substantially uniform. In addition, the present invention permits the use of a wider range of nozzle sizes with a single sprinkler body design, thus permitting greater flexibility of operation.

More specifically, the present invention includes an auxiliary braking means for the sprinkler and which restricts impact arm rotation when the arm rotation approaches or exceeds the intended design limits. The auxiliary braking means are activated after the impact arm has first rotated through a predetermined arc resisted by the conventional or primary spring, hereinafter referred to as the armspring. Cooperative means carried by the impact arm and the auxiliary braking means are engaged to activate the auxiliary means to cooperate with the armspring in restricting the rotation of the arm beyond the predetermined arc.

In the exemplary embodiments of the invention described herein, the auxiliary braking means comprise an auxiliary spring carried on the body of the sprinkler, and having a free end disposed in the path of arm rotation for engagement with the arm after it has rotated through a predetermined arc. Once the free end of the auxiliary spring has been engaged by the impulse arm, further rotation of the arm is restricted by the auxiliary spring in cooperation with the armspring, both springs acting together against the arm to reverse its direction of rotation. Preferably, the impact arm is permitted to travel through an arc of between 45° and 110° before the auxiliary spring is activated.

In one embodiment of the invention, the auxiliary spring is a coil spring, located between the impact arm and the body of the sprinkler, and having a free end extending into the path of arm rotation. In another embodiment of the invention, an elastomeric grommet is provided to increase the braking action of the armspring. In yet another embodiment, the auxiliary spring is a leaf spring secured at one end to the body and having a free end extending into the path of arm rotation for engagement with the rotating impact arm.

Other features and advantages of the recent invention will become apparent from the following detailed description taken in conjunction with the accompanying drawings.

DETAILED DESCRIPTION

As shown in the exemplary drawings, the present invention is embodied in an impact type rotary sprinkler which utilizes the force of a discharge stream to deflect a rotatable impact arm and impart increments of rotation to the sprinkler. In this manner, water is distributed over the area surrounding the sprinkler.

Figure 1:
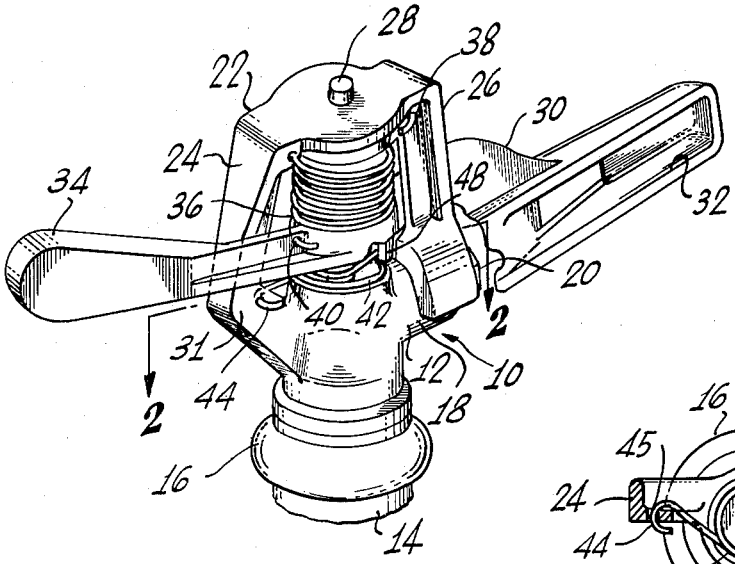
FIG. 1 is a perspective view of an impact type rotary sprinkler in accordance with the present invention, and having a torsion spring as the auxiliary braking means.

In this instance, as can be seen in FIG. 1, the impact type sprinkler, indicated generally as 10, includes a body 12 rotatably carried on a nipple 14 adapted for attachment to a water supply pipe or riser, not shown. A collar 16 is provided for fluid-tight connection between the sleeve 14 and the body 12.

The body 12 carries a spray nozzle 18 having a discharge orifice 20, and includes an inverted, generally U-shaped bridge 22 having legs 24 and 26 attached to or formed as part of the body. The nozzle 20 and the legs 24 and 26 are herein aligned on the body 12, and a pivot pin 28 is positioned between the legs 24 and 26 with its upper end affixed to the bridge 22 and its lower end affixed to the body 12.

For imparting an increment of rotation to the body 12, an impact arm 30 is rotatably mounted on the pivot pin 28 and carries a deflector spoon 32 on one end and a counterweight 34 on the opposite end. A torsion armspring 36 is disposed about the pivot pin 28 and is connected at one end 38 to the bridge 22 and at the opposite end 40 to the arm 30 for urging the arm in a clockwise direction, as shown in FIG. 1, to its rest position abutting against a contact surface 31 formed on the leg 26. In its rest position, the deflector 32 is aligned with orifice 20 of the nozzle 18. The impingement of a discharge stream of water from the nozzle 20 on the deflector 32 causes the arm 30 to rotate in a first direction, herein counter-clockwise, away from the discharge stream until the force of the armspring 36 overcomes the inertial force of the arm, reversing the direction of rotation of the arm and urging it back into engagement with the leg 26 whereupon the cycle is repeated. The force of the arm 30 striking the contact surface of the leg 26 imparts an increment of clockwise rotation of the body 12.

In accordance with the present invention, auxiliary means 41 are provided to limit travel of the impact arm 30 in cases where the rotation of the arm would otherwise exceed design limits because of increased water pressure levels or nozzle orifice diameters. Thus, erratic sprinkler rotation due to excess travel of the arm 30 is avoided, and the number of armstrokes per minutes is maintained substantially constant over a range of water pressures and orifice sizes so that sprinkler rotation and the resultant water distribution pattern remain substantially uniform.

Figure 2:
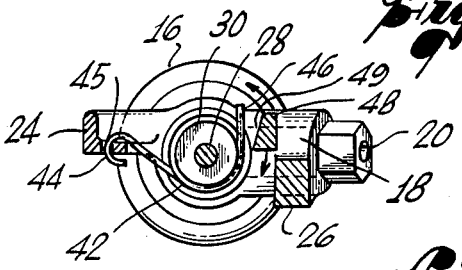
FIG. 2 is a fragmentary sectional view taken substantially along line 2—2 of FIG. 1, with the impact arm in its starting position in contact with the sprinkler body.
Figure 3:
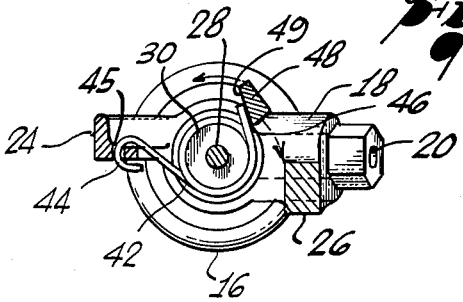
FIG. 3 is a view similar to that shown in FIG. 2, but with the impact arm partially rotated and in contact with the torsion spring.

More specifically, in the embodiment of FIGS. 1–3, the auxiliary means 41 comprises a secondary torsion spring 42 disposed about the pivot pin 28 between the body 12 and the impact arm 30. The secondary spring 42 is connected to the body 12 by one end 44 which is passed through an aperture 45 in the base of the leg 24. The end 44 is formed back on itself to define a hook for securing the secondary spring 42 to prevent the rotation thereof about the pivot pin 28. The opposite end 46 of the spring 42 is free, and extends tangentially outwardly from the pivot pin 28 to lie in the path of rotation of the arm 30. Herein, the arm 30 is provided with a downwardly disposed lug 48 including a contact face 49 for engagement with the free end 46 of the secondary spring during rotation of the arm (FIG. 3).

The free end 46 of the secondary spring 42 is positioned in the path of rotation of the arm 30 so that the arm rotates away from the discharge stream through a preselected deflection angle, for example between 45° and 110°, before the secondary spring is activated. Accordingly, the armspring 35 operates in the conventional manner to limit rotation of the impact arm 30 to a preselected deflection during operation of the sprinkler 10 at the water pressures and nozzle orifice diameters for which the sprinkler was originally designed. When, because of increased water pressure or nozzle orifice diameter, the rotational deflection of the arm 30 exceeds the retarding force of the armspring 36 so that overtravel of the arm could take place, the secondary spring 42 is activated to supply additional braking force to the arm and limit arm travel. The greater the rotational force applied to the arm 30 by the water stream issuing from the nozzle 20, the more will be the braking force of the secondary spring 42 so that uniformity of operation of the sprinkler 10 is maintained over a wide range of water pressures and orifice sizes.

Figure 4:
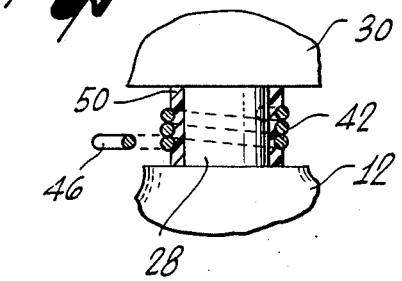
FIG. 4 is a fragmentary view, partly in section, showing another embodiment of the invention and utilizing an elastomeric sleeve as part of the auxiliary braking means.

In the embodiment of the auxiliary means 41 shown in FIG. 4, the braking force of the secondary spring 42 is increased by an elastomeric grommet 50 which surrounds the pivot pin 28 and provides a resilient interface between the pivot pin and the secondary spring 42. As the secondary spring 42 is activated in the manner previously described, the coil diameter of the secondary spring decreases resulting in a deformation of the grommet 50. Due to its elastic nature, the grommet 50 resists the decrease of the diameter of the coil spring 42, and in its deformed condition acts against the secondary spring to return it to its normal diameter. The force applied by the grommet 50 against the secondary spring 42 adds to the braking force applied to the arm 30.

While the auxiliary means 41 for limiting arm travel has been described as a coil spring, it is within the scope of this invention to utilize other spring forms. Thus, for example, a leaf spring may be employed as the auxiliary means 41 of the present invention.

Figure 5:
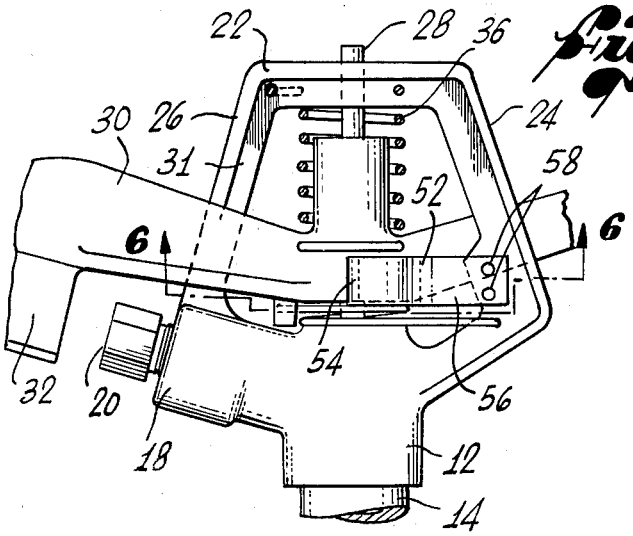
FIG. 5 is a side elevational view, with portions of the impact arm broken away for compactness of illustrations, illustrating another embodiment of the present invention and utilizing a leaf spring.
Figure 6:
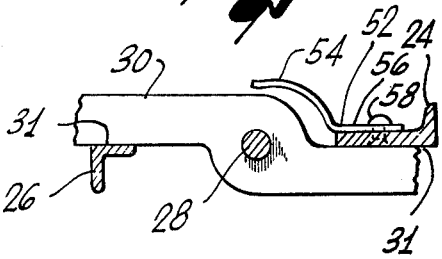
FIG. 6 is a fragmentary sectional view taken substantially along line 6—6 of FIG. 5.

More specifically, as can be seen in the embodiment of FIGS. 5 and 6, an elongated leaf spring 52 having an outwardly biased free end portion 54 and a planar end portion 56 is secured by suitable means, herein rivets 58, at its planar end portion to the body 12 at the base of the leg 24 remote from the nozzle 18. The leaf spring 52 extends normal to the axis of rotation of the arm 30 with its free end portion 54 spaced from the arm and disposed in the path of rotation of the arm away from the discharge stream for engagement by the arm to apply braking force thereto when the arm travel exceeds a predetermined deflection away from the discharge stream.

As with the embodiments described and shown in FIGS. 1–4, the free end 54 of the leaf spring 52 is spaced outwardly from the arm 30 to permit the arm to travel through an arc of 45° to 110° from the discharge stream before the spring is activated. In all cases, however, the degree of deflection is dependent upon the armspring 36, the desired armstrokes per minute, the desired increment of body rotation and the water pressures and orifice sizes for which the sprinkler 10 is intended to be used.

From the foregoing, it can be seen that the present invention provides an impulse sprinkler which is adapted for uniform water distribution over a range of water pressures and orifice sizes. By the provision of auxiliary means for restricting arm travel, overriding of the armspring by the impulse arm is avoided and the amount of arm travel is controlled at water pressures and orifice diameters greater than those for which the armspring was designed to operate.

While the invention has been described herein with reference to certain preferred embodiments thereof, it is to be understood that it may otherwise be modified without departing from the spirit and scope of the invention as defined by the appended claims.

I claim:

1. In an impact type rotary sprinkler having a body rotatably mounted on a fluid supply conduit, an impact arm rotatably mounted on said body for rotary oscillation about said body, an armspring carried by said body for urging said impact arm into contact with a portion of said body, a nozzle carried by said body oriented to direct a discharge stream against said arm to cause rotation thereof out of contact with said body and away from said stream, said armspring resisting said rotation and causing said arm to reverse its direction of rotation and to impact said body to impart an increment of rotation thereto in a forward direction, the improvement comprising:

auxiliary means carried by said body for supplementing the action of said armspring, and for preventing said impact arm from imparting any rotation to said body in a reverse direction, said means being activated by said arm after it has rotated through a predetermined arc, whereby said auxiliary means operates to prevent reverse rotation of said body when the rotational force applied to said arm by said discharge stream exceeds predetermined limits.

2. The improvement defined in claim 1 wherein said auxiliary means is activated after said arm has traveled away from said stream through an arc of between 45° and 110°.

3. The improvement defined in claim 1 wherein said auxiliary means comprises a spring carried by said body, said spring member having a free end lying in the path of rotation of said impact arm for engagement therewith as said arm rotates beyond said predetermined arc, thereby to activate said spring.

4. The improvement defined in claim 3 wherein said spring is a coil spring aligned coaxially with said arm spring and having its free end extending outwardly to lie in the path of rotation of said arm.

5. The improvement defined in claim 4 further including a downwardly depending lug on said impact arm, said lug engaging said free end of said coil spring as said arm rotates beyond said predetermined arc.

6. The improvement defined in claim 4 further including a resilient member surrounded by said coil spring, said resilient member being deformed by the decrease in coil diameter of said coil spring when said coil spring is activated to thereby cooperate with said coil spring and additionally resist rotation of said arm.

7. The improvement defined in claim 3 wherein said spring is an elongated leaf spring secured to said body and engageable with said impact arm, said leaf spring including an outwardly extending free end portion lying in the path of rotation of said arm.

8. An impact sprinkler comprising:

a rotatable body including a nozzle;

an elongated impact arm rotatably mounted on said body, one end of said arm extending beyond said body and adapted for the impingement by a fluid stream discharged from said nozzle to rotate said arm in a first direction;

an armspring interconnecting said body and said impact arm, said armspring urging said arm in a second and opposite direction and into contact with said body with said one end generally aligned with said nozzle; and auxiliary means mounted on said body to supplement the action of said armspring and to prevent said impact arm from imparting any rotation to said body in said first direction, said means being activated by said arm after said arm has been rotated through a predetermined arc in said first direction by the force of the discharge stream.

9. An impact sprinkler as defined in claim 8 wherein said auxiliary means comprises a coil spring secured at one end to said body and having an outwardly extending free end portion disposed in the path of rotation of said arm for engagement therewith after said arm has rotated in said first direction through the predetermined arc.

10. An impact sprinkler as defined in claim 9 further including an elastomeric member coaxially disposed within said coil spring, said member defining a resilient surface to act against said coil spring when engaged with said arm to assist said coil spring in restricting the rotation of said arm in said first direction.

11. An impact sprinkler as defined in claim 8 wherein said auxiliary means comprises an elongate leaf spring having a free end portion and a substantially planar end portion secured to said body, the free end portion thereof lying in the path of rotation of said arm in said first direction for engagement therewith after said arm has rotated through the predetermined arc.

12. An impact sprinkler comprising:

a rotatable body including a nozzle for ejecting a water stream from said body, an inverted U-shaped bridge having a spaced apart pair of support legs secured to said body and generally aligned with said nozzle;

an elongated impact arm rotatably mounted on said body by a pivot pin secured at one end to said bridge and at its opposite end to said body, one end of said arm extending beyond said body and carrying a deflector thereon, said deflector being adapted for impingement by the stream discharged from said nozzle and to rotate said arm in a first direction;

an arm spring disposed about said pivot pin between said bridge and said impact arm and being interconnected therebetween for urging said arm in a second and opposite direction and into contact with at least one of said legs with said deflector generally aligned with said nozzle;

a second coil spring disposed about said pivot pin between said impact arm and said body, said coil spring being secured at one end of said body and having a free end portion extending outwardly from said body and terminating in the path of rotation of said arm, said free end portion being spaced a predetermined angular distance from said nozzle; and a downwardly extending lug carried by said arm for engagement with said free end portion of said coil spring after said arm has rotated through a predetermined arc in said first direction, whereby said second coil spring is operative to prevent any motion in said first direction from being imparted to said body.

13. An impact sprinkler comprising:

a rotatable body including a nozzle for ejecting a water stream from said body, an inverted U-shaped bridge having a spaced apart pair of support legs secured to said body and generally aligned with said nozzle;

an elongated impact arm rotatably mounted on said body by a pivot secured at one end to said bridge and at its opposite end to said body, one end of said arm extending beyond said body and having a deflector coupled therewith, said deflector being adapted for impingement by the stream discharged from said nozzle to rotate said arm in a first direction;

an armspring disposed about said pivot pin between said bridge and said impact arm and being interconnected therebetween for urging said arm in a second and opposite direction into contact with at least one of said legs with said deflector generally aligned with said nozzle; and an elongated leaf spring having a free end portion and a substantially planar opposite end portion secured to said body, said leaf spring being secured to said body with said free end portion of said leaf spring being spaced from said impulse arm for engagement therewith after said arm has rotated through a predetermined arc in said first direction, whereby said leaf spring functions to prevent any motion in said first direction from being imparted to said body.

* * * * *

UNITED STATES PATENT AND TRADEMARK OFFICE

CERTIFICATE OF CORRECTION

PATENT NO. : 4,055,304

DATED : October 25, 1977

INVENTOR(S) : Robert L. Munson

It is certified that error appears in the above–identified patent and that said Letters Patent are hereby corrected as shown below:

Column 6, Line 56, insert --pin-- after "pivot".

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*